US005832756A

United States Patent [19]

Herman, Jr.

[11] Patent Number: 5,832,756

[45] Date of Patent: Nov. 10, 1998

[54] LOCK SET FOR SWINGING INDUSTRIAL DOOR

[75] Inventor: Stephen Robert Herman, Jr., Bend, Oreg.

[73] Assignee: Chase Industries, Inc., Cincinnati, Ohio

[21] Appl. No.: 733,840

[22] Filed: Oct. 18, 1996

[51] Int. Cl.[6] ..... E05B 63/12

[52] U.S. Cl. ..... 70/131; 70/104; 70/461; 292/341.18; 292/179

[58] Field of Search ..... 70/96, 102, 103, 70/104, 131, 142, 136, 461, 65, DIG. 4; 292/341.18, 341.19, 283, 179

[56] References Cited

U.S. PATENT DOCUMENTS

| | | | |
|---|---|---|---|
| 513,667 | 1/1894 | Buckingham | 292/341.18 |
| 2,019,263 | 10/1935 | Kemp | 70/131 |
| 2,103,989 | 12/1937 | Machinist | 70/131 |
| 3,746,380 | 7/1973 | Kartarik | 70/104 |
| 3,796,071 | 3/1974 | Crepinsek | 70/131 |
| 3,827,266 | 8/1974 | Walters | 70/104 |
| 3,899,905 | 8/1975 | Walters | 70/104 |
| 3,921,422 | 11/1975 | Walters | 70/104 |
| 3,940,957 | 3/1976 | Walters | 70/104 |
| 4,067,212 | 1/1978 | Vorob | 70/103 |
| 4,227,386 | 10/1980 | Crockett | 70/131 |
| 4,432,575 | 2/1984 | Garvey et al. | 292/341.19 |
| 4,480,864 | 11/1984 | Parlier | 292/341.18 |
| 4,548,060 | 10/1985 | Campbell | 70/101 |
| 4,617,811 | 10/1986 | Roop | 70/131 |
| 4,709,565 | 12/1987 | Lin | 70/107 |
| 4,719,774 | 1/1988 | Newman et al. | 70/102 |
| 4,813,250 | 3/1989 | Yeh | 70/104 |
| 4,813,254 | 3/1989 | Foshee | 70/104 |
| 4,991,416 | 2/1991 | Resendez . | |
| 5,352,001 | 10/1994 | Shieh | 292/341.18 |

*Primary Examiner*—Darnell M. Boucher
*Attorney, Agent, or Firm*—Townsend and Townsend and Crew

[57] ABSTRACT

A lockset for paired swinging industrial doors is provided with adjustable mounting to enlarged two inch chain apertures in the doors. The lockset includes a keyset side having a key actuated male vertical bolt for fitting to one door, and a female bolt receiving side for defining female bolt receiving apertures for locking to the key actuated male vertical bolt. The vertical bolt on the keyset side, and the female bolt receiving apertures on the female bolt receiving side of the lock extend parallel to the axis of the paired door hinges.

13 Claims, 5 Drawing Sheets

LOCK SET FOR SWINGING INDUSTRIAL DOOR

This invention relates to paired swinging industrial doors of the type having large circular holes or chain apertures for securing the doors with chains. More particularly, a lock set is disclosed which fits into the chain apertures and does away with the need for chains. The lock set accommodates large degrees of misalignment common to the installation of such industrial doors.

BACKGROUND OF THE INVENTION

Brown U.S. Pat. No. 4,084,347 issued Apr. 18, 1978, and Johnson et al. U.S. Pat. No. 5,528,865 issued Jun. 25, 1996 disclose so-called rotational molded insulated plastic industrial doors. By way of summary, these doors constitute a rotational molded shell reinforced with some steel framing which is then injected with foam. Such doors are constructed to withstand what would otherwise be considered as extreme abuse; it is not uncommon for such doors to be opened by having fork lifts and other equipment impact driven into the doors causing the doors to rapidly fly open upon impact.

Because of this abuse, such doors are not and usually cannot be precision mounted. Consequently, conventional locking mechanisms extending between the doors are not used. Conventional door locks require the locked doors to be hung relative to one another with comparative precision. Instead, locking of such doors most commonly includes the combination of so-called "cane locks" with case hardened padlocks and chain. Typically, the cane locks—looking not at all unlike conventional canes—slide from bracket supports into and out of holes in the lintel and sill of the door. When the cane lock engages between the swinging door and a receiving hole in either the sill or lintel, the doors no longer swing.

When such an engagement is made, the case hardened chain and padlock fits through two inch diameter holes on the edges of the door opposite the hinge. Typically the chain is then locked with the padlock, securing the door to the closed position.

This method of industrial door locking has many disadvantages. First, and during the time that the industrial doors are open, the chain must be stored away from the door. The chain cannot be left with the door as it interferes with the swinging of the doors. Further, when it is remembered that the doors are impact opened, the presence of attached chain at the swinging edge of the door away from the hinge cannot be tolerated.

Second, because of the rugged nature of such paired industrial doors, door mounting frequently is other than perfectly plumb. As a consequence, the door seldom align with each other. For example, the doors can each be mounted at differing elevations. Likewise, when closed and locked, the paired doors may not be in the same plane. As a direct consequence, the two inch apertures formed in the doors for the passage of chain, likewise seldom precisely align with each other.

Finally, and unless two duplicate padlocks are utilized, such doors cannot be opened from either side. Thus, entrance to space secured by the doors is usually made by a conventional entry located elsewhere and access then had to the securing padlock which is usually placed inside the door. Thereafter, the padlock is released, the chain and padlock removed and stored, and the doors released for use.

It will be noted that a substantial number of existing doors are equipped with chain apertures for holding the doors in the locked position. Because of the foregoing disadvantages, it would be desirable to equip these doors with retro-fitted locks.

SUMMARY OF THE INVENTION

A lockset for paired swinging industrial doors is provided with adjustable mounting to enlarged two inch chain apertures in the doors. The lockset includes a keyset side having a key actuated male vertical bolt for fitting to one door, and a female bolt receiving side for defining female bolt receiving apertures for locking to the key actuated male vertical bolt. The vertical bolt on the keyset side, and the female bolt receiving apertures on the female bolt receiving side of the lock extend parallel to the axis of the paired door hinges.

The keyset side and the female bolt receiving side of the locks relatively move towards and away from one another. Such movement occurs from a position where the two sides of the lock can engage and lock the swinging doors to a position where both lock sides are out of interfering relationship with the swinging movement of the doors.

In the preferred embodiment, the keyset side of the lock is recessed from the door hinge out of interference with the paired door edges when the doors swing during use. The female bolt receiving side of the lockset reciprocates between a first extended position for locking to the keyset side at the bolt action lock and a retracted position for enabling the doors to swing without interference between the lockset and door.

Both the keyset side and female bolt receiving side can fit to door chain apertures at enlarged eccentrically mounted shafts capped on one end by a flange and on the opposite end by the respective keyset side and female bolt receiving side. Vertical misalignment can be compensated on both lock portions by rotation on of either the keyset side or female bolt receiving side on the eccentric shafts to level the lockset sides despite vertical misalignment of the doors. Alternately, the respective sides of the lock can be mounted at an angle other than horizontal with respect to the chain apertures. In the preferred embodiment here illustrated, only the female bolt receiving side of the lock is fitted for such eccentric movement about a chain aperture to which the lock is fitted.

Installation includes fastening of the respective keyset and female bolt receiving sides relative to one another by engaging the vertical bolts and bolt apertures. Once lock engagement is measured and assured relative to the chain apertures, fastening of the locks in rotational position with respect to the chain apertures occurs. The keyset side and female bolt receiving side mate at respective vertical bolts and vertical bolt apertures. This enables the locked keyset and female bolt receiving side to have limited hinge action when locked.

Provision is made to inhibit lock disassembly from the keyset side unless the bolt is in the unlocked position. Additionally, spring actuated retraction of the female bolt receiving side of the lock assures automatic retraction of the lock away from positions of interference with the door edges when the doors are in the open position.

DESCRIPTION OF THE PREFERRED EMBODIMENT

Figure 1:
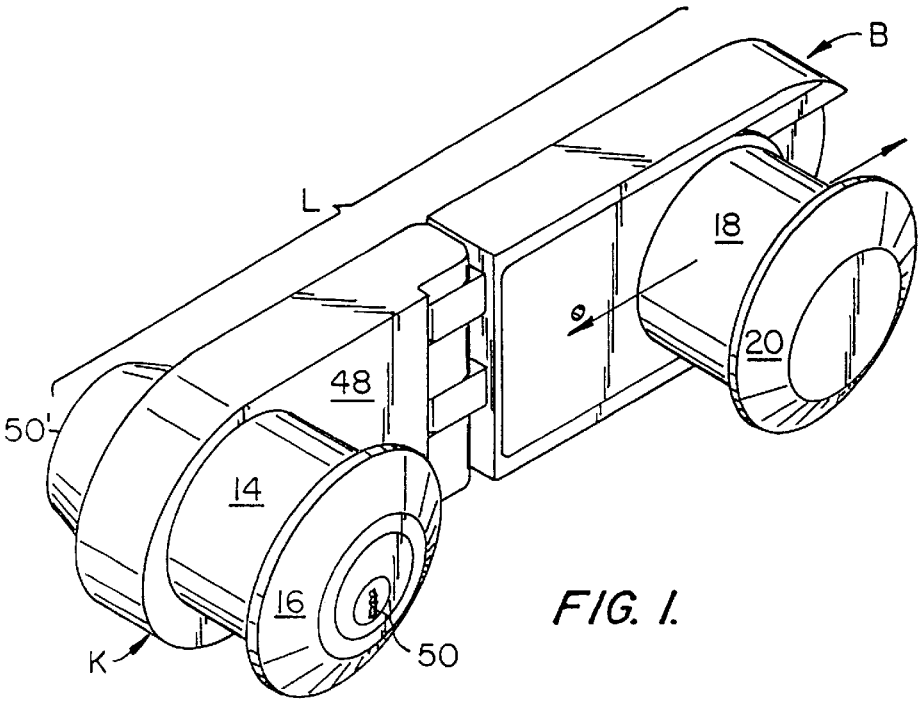
FIG. 1 is a perspective view of the lockset of this invention not mounted to a door illustrating the keyset side engaged to the female bolt receiving side with schematic arrows indicating the direction of reciprocation and the slight hinge action between the locked sides at the engaged vertical bolt.
Figure 2A:
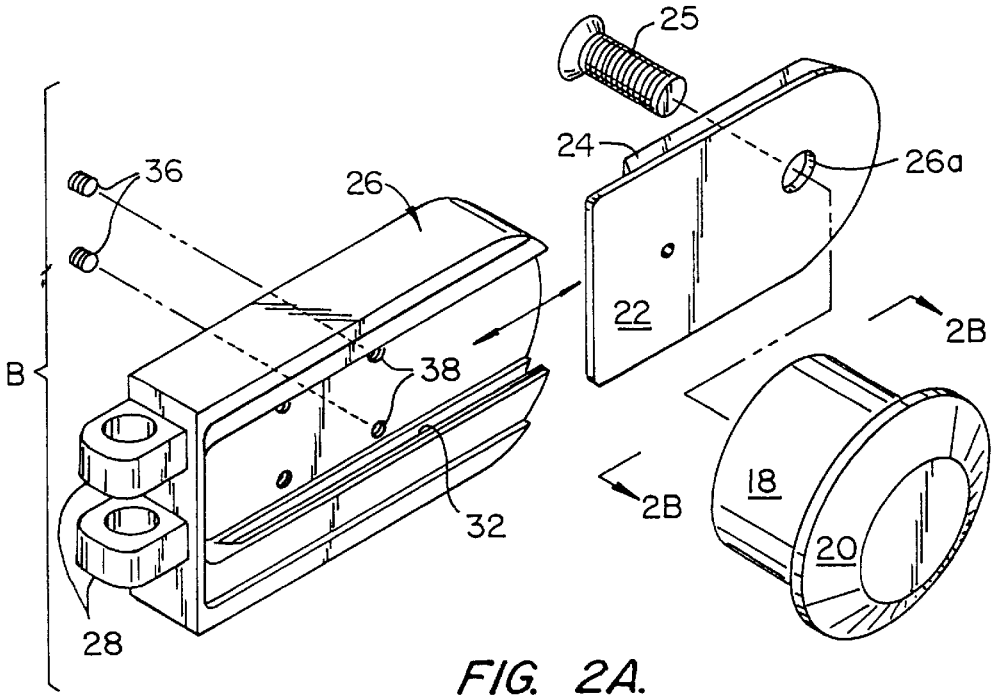
FIG. 2A is an exploded perspective view of the female bolt receiving side of the lockset illustrating the eccentric mounting of the flange for keying to the chain lock aperture in a swinging door.
Figure 2B:
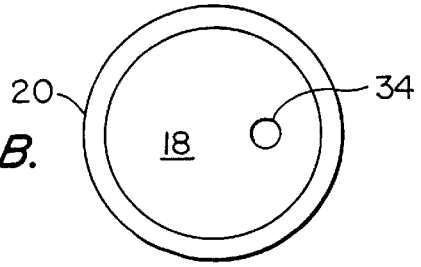
FIG. 2B is a rear view of the female bolt receiving shaft illustrating the eccentric mounting of the shaft.
Figure 3:
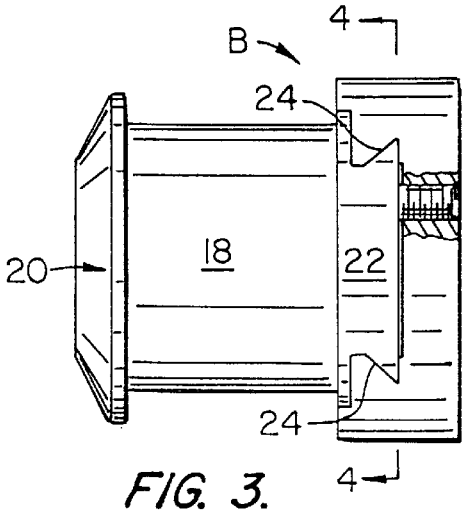
FIG. 3 is a side elevation of the assembled female bolt receiving side of the lock.
Figure 4:
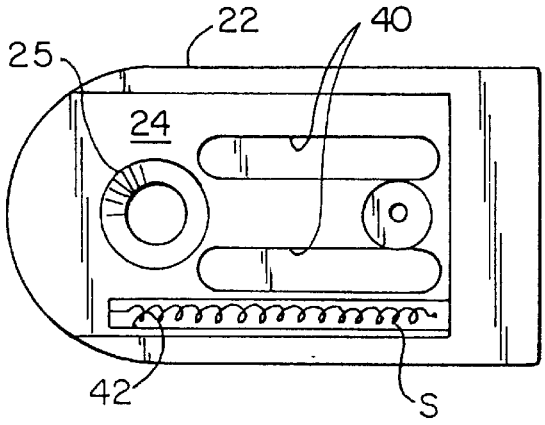
FIG. 4 is a rear view of the lock at the sliding dove tail plate along lines 4—4 of FIG. 3 illustrating the limited sliding motion of the lock and a spring bias for holding the lockset in the retracted position during normal unlocked swinging operation of the industrial doors.

Referring to FIG. 1, lock L is shown with keyset side K and bolt receiving side B engaged. Keyset side K has keyset securing shaft 14 attached with keyset flange 16 at one end and keyset side K at the other end. Likewise, bolt receiving side B has female bolt securing shaft 18 attached with bolt side securing flange 20 at one end and bolt receiving side B at the other end. It therefore can be understood that where chain apertures within swinging doors have the size of keyset securing shaft 14 and female bolt securing shaft 18, capture of the lock to the chain receiving apertures is assured.

Referring to FIGS. 2A, 2B, 3 and 4, bolt receiving side B of lock L can be understood. Door secured dove tail plate 22 has male dove tail 24. Female bolt aperture fitting 26 has vertical female bolt apertures 28 for receiving vertical male bolts 30. At the same time, female bolt aperture fitting 26 defines female dovetail 32 which is complimentary to male dove tail 24 on door secured dove tail plate 22. Once female bolt securing shaft 18 is secured within a chain aperture, door secured dove tail plate 22 is fastened to female bolt securing shaft 18 by bolt 25 through apertures 26*a*. Thereafter, male dove tail 24 is fitted to female dovetail 32 permitting relative sliding movement between female bolt aperture fitting 26 and door secured dove tail plate 22.

Emphasis has previously been placed on the difficulty of hanging industrial doors so that their respective chain apertures are precisely aligned. This lock makes two accommodations for this likely misalignment.

First, female bolt securing shaft 18 as it is secured to door secured dove tail plate 22 by bolt 25 has threaded bolt receiving aperture 34 eccentrically mounted. Thus, by relative rotation of female bolt securing shaft 18 about threaded bolt receiving aperture 34, limited up and down movement of door secured dove tail plate 22 and thus bolt receiving side B can occur.

Second, respective keyset securing shaft 14 and female bolt securing shaft 18 enable the entire lock L to be mounted other than horizontal. In cases of extreme misalignment between the respective chain apertures, lock L can extend across the misaligned chain apertures in an other than perfectly horizontal mode.

Considering the sliding relationship between door secured dove tail plate 22 and female bolt aperture fitting 26, two additional considerations are required. First, it is necessary to limit the range of sliding motion. Second, it is required to have the respective keyset side K and bolt receiving side B moved out of interfering relationship during normal use of the industrial door.

Regarding the limitation of sliding relative movement between door secured dove tail plate 22 and female bolt aperture fitting 26, that set screws 36 fit through set screw apertures 38 in female bolt aperture fitting 26 within female dovetail 32. Complimentary to set screws 36 in set screw apertures 38, slots 40 are configured within door secured dove tail plate 22 at the base of male dove tail 24. Thus, it will be understood that the actions of set screws 36 in slots 40 limits the relative sliding motion between door secured dove tail plate 22 and female bolt aperture fitting 26.

Secondly, and regarding the bias of female bolt aperture fitting 26 to a position where it is out of interference with keyset side K and the edges of confronting doors, spring S is placed within spring slot 42. This spring S acts in tension between door secured dove tail plate 22 and female bolt aperture fitting 26 assuring that the latter is normally retracted (See FIG. 5).

Figure 5:
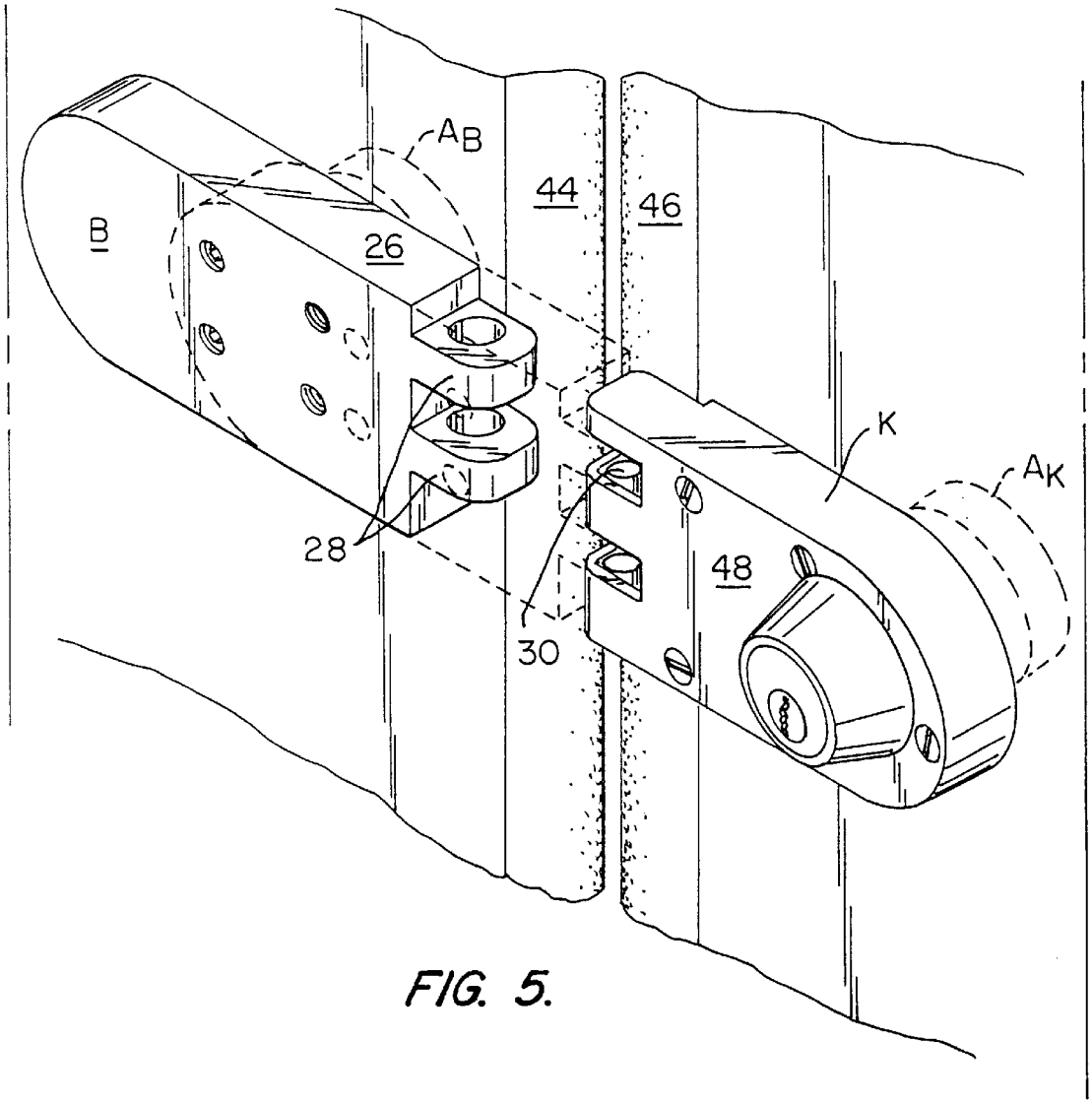
FIG. 5 is a perspective view of the lockset mounted to the swinging edges of paired industrial doors with the keyset side shown mounted with its vertical bolt retracted from interference at the door edges and the female bolt receiving side illustrated in the retracted position with the locked position of the female bolt receiving side being shown in broken lines.
Figure 6:
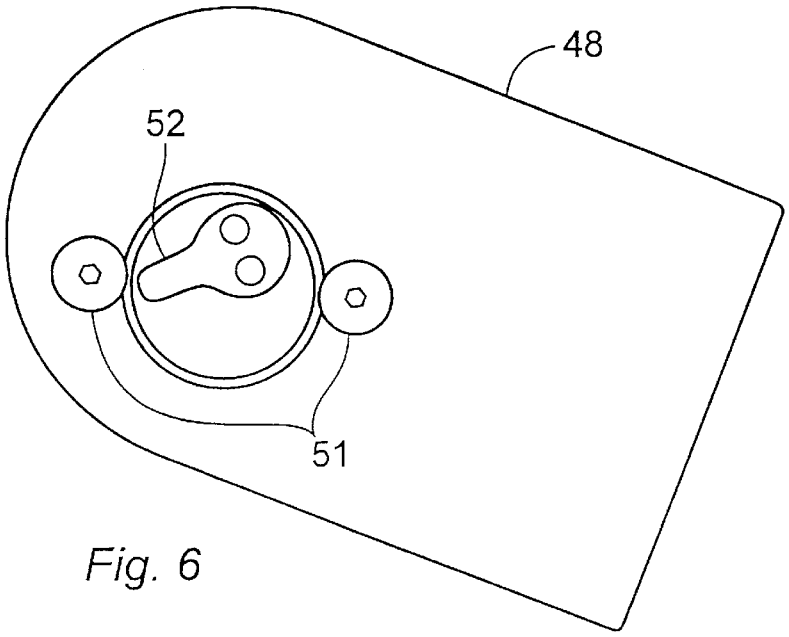
FIG. 6 is a disassembled plan view of the lockset side with the lockset pawl being exposed to the viewed with the conventional keyway being hidden from view.

Referring to FIG. 5, the chain apertures are illustrated. Bolt receiving key aperture $A_B$ and keyset receiving aperture $A_K$ illustrated having the respective bolt receiving side B and keyset side K secured. A moment to understand the relative positions of these respective members to keyset confronting door edge 46 and bolt receiving door edge 44 can be useful.

Keyset side K is dimensioned so that vertical male bolts 30 and the surrounding portions of keyset side K are out of interference with bolt receiving door edge 44. Thus, it will be understood that vertical male bolts 30 are recessed back from keyset confronting door edge 46.

Bolt receiving side B reciprocates. It moves under the bias of spring S normally to a position where vertical female bolt apertures 28 are away from interference with keyset confronting door edge 46. Thus in the normal position, vertical female bolt apertures 28 are recessed well inside bolt receiving door edge 44.

When locking of the respective doors is required, female bolt aperture fitting 26 is moved so that vertical female bolt apertures 28 can engage vertical male bolts 30. This disposition is shown in broken lines in FIG. 5.

Having set forth bolt receiving side B, keyset side K can now be described with respect to FIGS. 6–10. Since much of what follows is conventional in the lock arts, this description will be abbreviated.

First, keyset K has keyset cover plate 48. Keyset cover plate 48 has conventional keyset 50 attached concentrically through keyset securing shaft 14. Attachment occurs through shaft attaching bolts 51. Keyset actuated pawl 52 extends from conventional keyset 50 and is actuated by a conventional key.

Second, keyset side K includes lock housing 54. This lock housing 54 is covered by keyset cover plate 48. Referring briefly to lock housing 54, it will be seen that second lock pawl 52' actuated by second conventional keyset 50' is illustrated. Naturally, it may be desired to replace this side of lock L with a conventional thumb screw not requiring opening of the lock from one side with a key.

Figure 9:
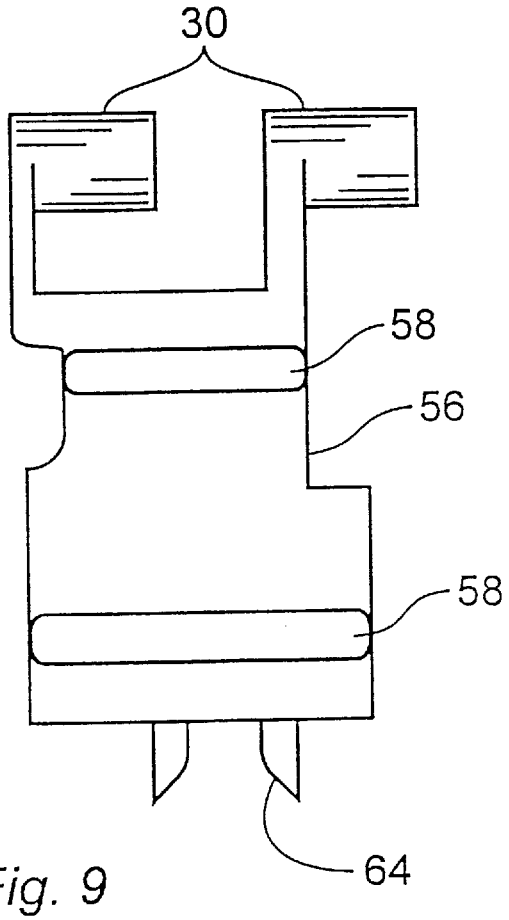
FIG. 9 is an illustration of the male bolt member with linear keys and keyways that enable sliding action with respect to the lock; and, FIG. 10 is a detail of the lock latch.

The simplicity of this lock construction can best be understood by referring now to FIG. 9. Vertical male bolts 30 are shown integral to vertical bolt plate 56. Vertical bolt plate 56 is provided with vertical male slide slots 58 which fit to corresponding vertical male slide slots 59 in lock housing 54. Thus, vertical male bolts 30 may slide up and down relative to lock housing 54.

Having established that vertical bolt plate 56 can slide up and down relative to lock housing 54, the dispositions of vertical male bolts 30 in each position should be understood. At the end of lock housing 54, there is provided bolt shielding housing members 60 defining bolt exposing members 62 therebetween. When vertical bolt plate 56 is in the position shown in FIG. 7, vertical male bolts 30 are within shielding housing members 60. In this position, keyset side K can move into and out of engagement with bolt receiving side B.

Figure 8:
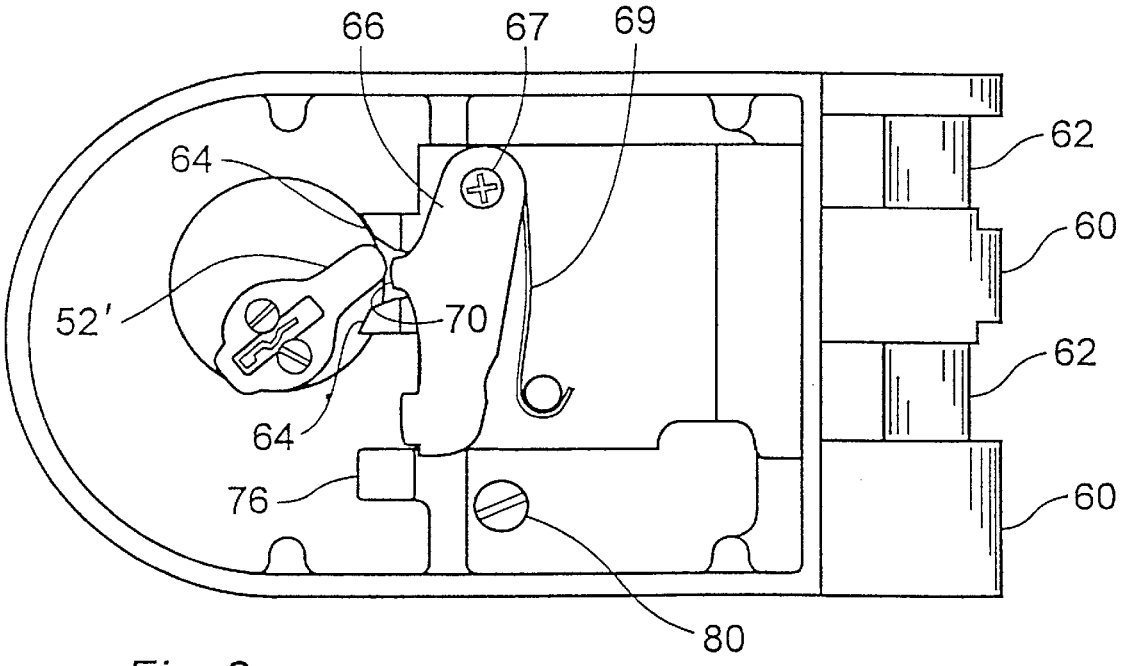
FIG. 8 is a view similar to FIG. 7 with the male pawl having the bolt in the locked position through interaction with the female pawl actuator with the lock latch holding the lock in the locked disposition.

When vertical bolt plate 56 is in the position shown in FIG. 8, vertical male bolts 30 are within bolt exposing members 62. In this position, and assuming that registry has occurred between vertical female bolt apertures 28 of bolt receiving side B and bolt exposing members 62, locking between the respective lock side can occur.

Returning to FIG. 9, vertical bolt plate 56 has key pawl receiving slot 64. This key pawl receiving slot 64 receives keyset actuated pawl 52 and second lock pawl 52'. Together, the respective pawls cause vertical bolt plate 56 and vertical male bolts 30 to move responsive to keys turning either of conventional keyset 50 or second conventional keyset 50'.

Figure 10:
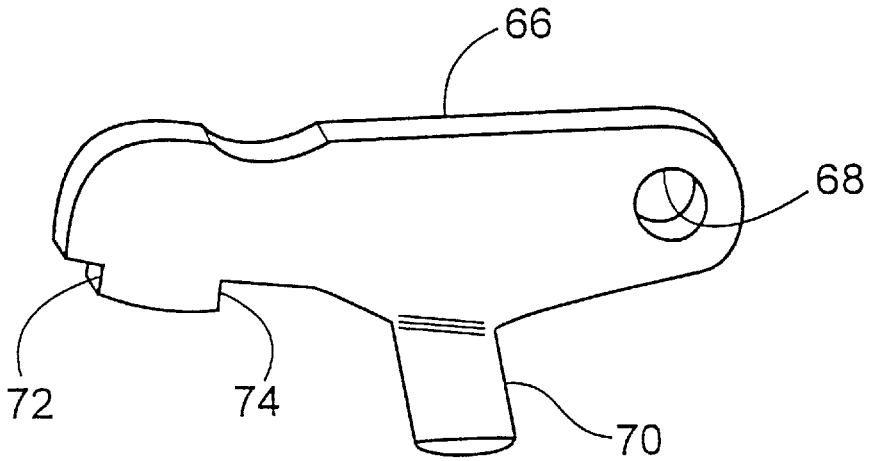

Keyset side K includes latch 66 best shown in FIG. 10. Latch 66 is secured to vertical bolt plate 56 at screw 67 and biased outward of key pawl receiving slot 64 by hair spring 69. Hair spring 69 is biased against vertical bolt plate post 71 at one end, winds around screw 67 in the central portion and is outwardly sprung against key pawl 70 on latch 66 (See FIGS. 7, 8, and 10).

By now, operation of lock L at keyset K should be easy to understand. Presuming that either conventional keyset 50 or second conventional keyset 50' are turned, both respective keyset actuated pawl 52 and second lock pawl 52' will likewise turn. Either pawl 52 or 52' will cause latch 66 to compress hair spring 69 and rotate away from the position shown in either FIG. 7 or FIG. 8. Therefore, all the remains to be shown is the relative movement between the positions of FIGS. 7 and 8.

Returning to FIG. 10, it will be seen that latch 66 has two latching cams; locking latching cam 72 and open latching cam 74. Presume that keyset K has vertical male bolts 30 in the open position shown in FIG. 7. Either of keyset actuated pawl 52 or second lock pawl 52' turns counterclockwise. Latch 66 is depressed against key pawl 70 within key pawl receiving slot 64 disengaging open latching cam 74 in its engagement with cam post 76. Key pawl receiving slot 64 causes vertical bolt plate 56 to move having vertical male bolts 30 penetrate bolt exposing members 62. Lock L then moves to the position shown in FIG. 8. Latch 66 then engages open latching cam 74 against cam post 76. Lock L is then held in the open position (See FIG. 8).

Figure 7:
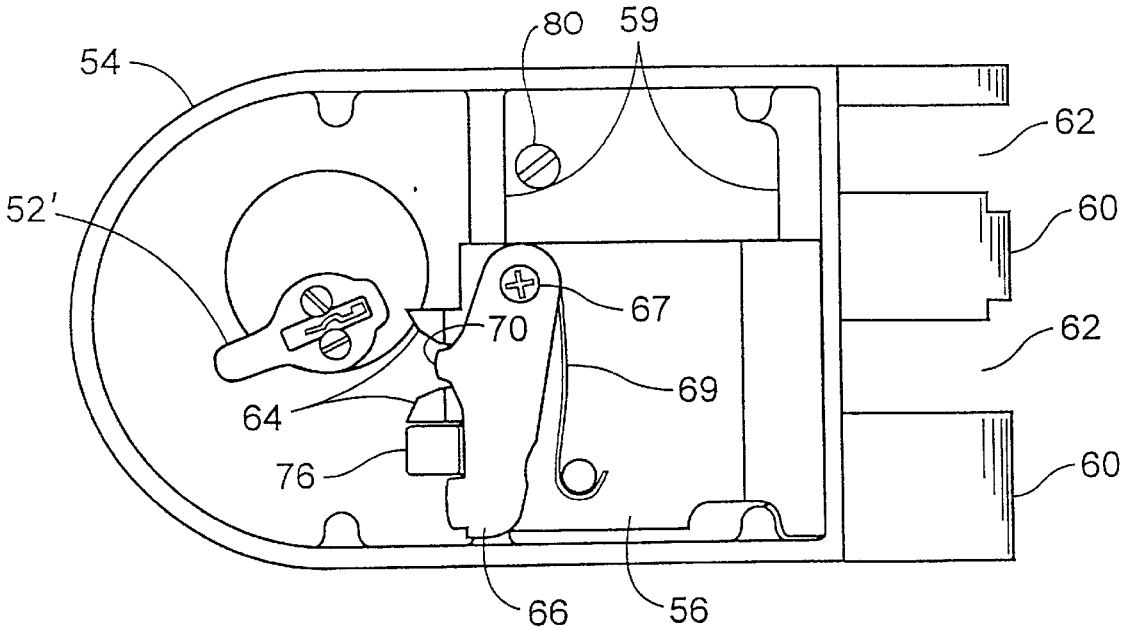
FIG. 7 is a disassembled plan view of the lockset side with the female pawl actuator illustrated in connection to the lock latch with the latch shown with the lock in the open position for exposing screws permitting total lock detachment from the swinging door.

It will be understood by the reader that moving from the position of FIG. 8 to the position of FIG. 7 is the precise reverse of the above description. This description will not be repeated here.

One feature of vertical bolt plate 56 remains to be discussed. Conceivably, someone without a key may try and obtain opening of lock L by opening lock housing 54 away from keyset cover plate 48. In this event, at least one lock fastening screw 80 can lie under the path of vertical bolt plate 56. Lock fastening screw 80 is exposed when lock L is in the open position (See FIG. 7) and covered when lock L is in the locked disposition (See FIG. 8).

What is claimed is:

1. A lockset for paired swinging doors, the paired swinging doors each having parallel vertical hinges along jamb edges, two juxtaposed confronting door edges opposite the jamb edges; and, chain apertures in each door proximate the juxtaposed confronting door edges, the chain apertures defining openings through the doors from one door side to an opposite door side at approximately identical elevations; the lockset comprising in combination:

a keyset lock side having a keyset, a lock latch and vertical bolt moveable between and open and locked position, the vertical bolt operatively connected to the keyset and the lock latch;

a keyset securing shaft for fitting through and occupying the chain aperture in one of the paired swinging doors, the keyset securing shaft mounted to the keyset lock side on one end;

a flange for securing to an opposite end of the keyset securing shaft;

means for securing the flange to the keyset securing shaft within the chain aperture of the door to enable fastening of the keyset lock side to the chain aperture of the door;

a female bolt lock side defining a vertical female bolt receiving apertures;

a female bolt lock side securing shaft for fitting through and occupying the chain aperture in the other of the paired swinging doors;

a flange for securing to an opposite end of the female bolt lock side securing shaft;

means for securing the flange to the female bolt lock side securing shaft within the chain aperture of the door; and, means for mounting the keyset lock side and the female bolt lock side for relative reciprocating movement between a first relative position where the vertical bolt and the vertical female bolt receiving apertures engage and a second relative position where the vertical bolt and the vertical female bolt receiving apertures do not engage.

2. A lockset for paired swinging doors according to claim 1 and further including:

means for permitting limited hinged movement between the keyset side and bolt securing side at an axis through the vertical bolt and the vertical female bolt receiving apertures.

3. A lockset for paired swinging doors according to claim 1 and further including:

at least one removable fastener for securing the keyset side to a door at the chain aperture;

means operable by the keyset for preventing access to the removable fastener when the keyset is in the locked position and permitting access to the removable fastener when the keyset is in the unlocked position.

4. A lockset for paired swinging doors according to claim 1 and further including:

means for spring biasing the keyset lock side and the female bolt lock side for relative reciprocating movement to the second relative position where the vertical bolt and the vertical female bolt receiving apertures do not engage.

5. A lockset for paired swinging doors according to claim 1 and further including:

an eccentric mount for at least one of the keyset securing shafts or the female bolt lock side securing shafts to enable relative eccentric rotation of one of the respective keyset side or female bolt lock side to the chain apertures for changing the relative elevation with respect to the chain apertures.

6. In combination:

paired swinging doors, the paired swinging doors each having parallel vertical hinges along jamb edges, two juxtaposed confronting door edges opposite the jamb edges; and, chain apertures in each door proximate the juxtaposed confronting door edges, the chain apertures defining openings through the doors from one door side to an opposite door side at approximately identical elevations;

a keyset lock side having a keyset, a lock latch and vertical bolt moveable between and open and locked position, the vertical bolt operatively connected to the keyset and the lock latch;

a keyset securing shaft for fitting through and occupying the chain aperture in one of the paired swinging doors, the keyset securing shaft mounted to the keyset lock side on one end;

a flange for securing to an opposite end of the keyset securing shaft;

means for securing the flange to the keyset securing shaft within the chain aperture of the door to enable fastening of the keyset lock side to the chain aperture of the door;

a female bolt lock side defining a vertical female bolt receiving apertures;

a female bolt lock side securing shaft for fitting through and occupying the chain aperture in the other of the paired swinging doors;

a flange for securing to an opposite end of the female bolt lock side securing shaft;

means for securing the flange to the female bolt lock side securing shaft within the chain aperture of the door; and, means for mounting the keyset lock side and the female bolt lock side for relative reciprocating movement between a first relative position where the vertical bolt and the vertical female bolt receiving apertures engage and a second relative position where the vertical bolt and the vertical female bolt receiving apertures do not engage.

7. The combination of claim 6 and further including:

means for permitting limited hinged movement between the keyset side and bolt securing side at an axis through the vertical bolt and the vertical female bolt receiving apertures.

8. The combination of claim 6 and further including:

at least one removable fastener for securing the keyset side to a door at the chain aperture;

means operable by the keyset for preventing access to the removable fastener when the keyset is in the locked position and permitting access to the removable fastener when the keyset is in the unlocked position.

9. The combination of claim 6 and further including:

means for spring biasing the keyset lock side and the female bolt lock side for relative reciprocating movement to the second relative position where the vertical bolt and the vertical female bolt receiving apertures do not engage.

10. The combination of claim 6 and further including:

an eccentric mount for at least one of the keyset securing shafts or the female bolt lock side securing shafts to enable relative eccentric rotation of one of the respective keyset side or female bolt lock side to the chain apertures for changing the relative elevation with respect to the chain apertures.

11. A process for mounting a lockset to paired swinging doors, the paired swinging doors each having parallel vertical hinges along jamb edges, two juxtaposed confronting door edges opposite the jamb edges; and, chain apertures in each door proximate the juxtaposed confronting door edges, the chain apertures defining openings through the doors from one door side to an opposite door side at approximately identical elevations; the process comprising the steps of:

providing a keyset lock side having a keyset, a lock latch and vertical bolt moveable between and open and locked position, the vertical bolt operatively connected to the keyset and the lock latch;

providing a keyset securing shaft for fitting through and occupying the chain aperture in one of the paired swinging doors, providing a flange on one end of the keyset securing shaft;

passing said keyset securing shaft through the chain aperture of the door;

securing the keyset securing shaft to the keyset lock side at an opposite end for confining the keyset securing shaft within the chain aperture of the door;

providing a female bolt lock side defining a vertical female bolt receiving apertures;

providing a female bolt lock side securing shaft for fitting through and occupying the chain aperture in the other of the paired swinging doors;

passing the female bolt lock side securing shaft through the chain aperture of the door;

securing the bolt lock side to the bolt lock side securing shaft at an opposite end of the bolt lock side securing shaft for confining the female bolt lock side securing shaft within the chain aperture of the door;

providing means for mounting the keyset lock side and the female bolt lock side for relative reciprocating movement between a first relative position where the vertical bolt and the vertical female bolt receiving apertures engage and a second relative position where the vertical bolt and the vertical female bolt receiving apertures do not engage;

reciprocating the keyset lock side and the female bolt side into the first relative position where the vertical bolt and the vertical female bolt receiving apertures engage; and, fastening the keyset lock side and the female bolt side relative to the chain apertures.

12. A process for mounting a lockset to paired swinging doors according to claim 11 and comprising the further steps of:

providing at least one removable fastener for securing the keyset side to a door at the chain aperture;

providing means operable by the keyset for preventing access to the removable fastener when the keyset is in the locked position and permitting access to the removable fastener when the keyset is in the unlocked position; and, moving the keyset to the unlocked position; and, securing the keyset side to the door utilizing the fastener.

13. A process for mounting a lockset to paired swinging doors according to claim 11 and comprising the further steps of:

providing an eccentric mount for at least one of the keyset securing shafts or the female bolt lock side securing shafts to enable relative eccentric rotation of one of the respective keyset side or female bolt lock side to the chain apertures; and, rotating the one of the shafts for changing the relative elevation with respect to the chain apertures.

* * * * *